US005522324A

United States Patent [19]

van Gelder et al.

[11] Patent Number: 5,522,324

[45] Date of Patent: Jun. 4, 1996

[54] SECTIONAL TABLE FOR SPECIAL USE

[75] Inventors: Martinus C. van Gelder, Schijndel; Petrus J. M. Pennings, Volkel, both of Netherlands

[73] Assignee: Van Gelder-Pennings Metaal B.V., 's-Hertogenbosch, Netherlands

[21] Appl. No.: 231,473

[22] Filed: Apr. 21, 1994

[30] Foreign Application Priority Data

Apr. 23, 1993 [NL] Netherlands ..... 9300703

[51] Int. Cl.[6] ..... A47B 35/00

[52] U.S. Cl. ..... 108/50; 108/64

[58] Field of Search ..... 108/50, 64, 108, 108/23, 59, 60

[56] References Cited

U.S. PATENT DOCUMENTS

| | | | |
|---|---|---|---|
| 3,550,785 | 12/1970 | Setz | 108/108 X |
| 4,094,256 | 6/1978 | Holper et al. | 108/50 |
| 4,679,510 | 7/1987 | Veyhl et al. | 108/64 X |
| 4,762,072 | 8/1988 | Boundy et al. | 108/50 |
| 4,838,177 | 6/1989 | Vander Park | 108/50 X |
| 5,037,164 | 8/1991 | Neissenbach et al. | 108/50 |
| 5,103,741 | 4/1992 | Grund et al. | 108/50 |
| 5,161,701 | 11/1992 | Berny | 108/108 X |

FOREIGN PATENT DOCUMENTS

| | | | |
|---|---|---|---|
| 2353173 | 4/1975 | Germany | 108/50 |

*Primary Examiner*—Jose V. Chen

*Attorney, Agent, or Firm*—Edmund M. Jaskiewicz

[57] ABSTRACT

A sectional table for special use as a work table in clean rooms has for each table section two identical vertical stands and each stand has two vertical legs interconnected at their tops to define an inverted U, each of the legs has several horizontal threaded bushes running lengthwise and in an airtight manner therein for detachably fixing leaf supports between them, for supporting one or more table leaves and for detachably fixing a partition between corresponding legs of each stand. Each stand is shut off in an airtight manner at the bottoms of the legs to form an air buffer. Each of the legs has two connection points for connecting to a supply system for purified compressed air and connecting to a through air line on the partition. Each partition also has a power supply strip for the electrical main supply.

12 Claims, 4 Drawing Sheets

SECTIONAL TABLE FOR SPECIAL USE

The invention relates to a sectional table for special use, in particular for use as a work table in so-called clean rooms.

For a general introduction, terms and definitions for clean rooms and clean air devices, you are referred to British Standard BS 5295, Parts 0 to 4. According to the number of particles per unit volume, a classification is made into ten classes of purity for a room suitable for industrial, medical and pharmaceutical purposes.

When faced with designing a table at which personnel in protective clothing have to assemble, for example, products from high-precision or electronic parts in clean room conditions, one must ensure that in every case all conducting and metal parts of the table are earthed, so that any static charge occurring (which can, of course, cause dust concentrations) is immediately conducted to earth. Furthermore, one of the power sources preferably used in a clean room is very highly purified compressed air, which is, of course, prepared outside the room and brought into the room through an appropriate network of lines. Since, in addition, a production line in such a room is not always intended for the same product, but has to be altered in order to switch over to another product and another production method, it is also a practical requirement that the table should be simple to set up, extend, disassemble and alter.

SUMMARY OF THE INVENTION

The object of the invention is to provide a table which in all respects meets the requirements set for clean rooms. Another object of the invention is to provide a table which is easy and quick to place and move if necessary. A further object of the invention is to provide a table which can be altered in a simple way according to the circumstances in the workroom.

Yet another object of the invention is to provide a sectional table for special use which can be extended very easily and quickly on either side by means of corresponding tables.

Yet a further object of the invention is to provide a sectional table for special use which can be connected quickly and easily to adjacent, corresponding tables, without departing from the inherent requirements of purity and safety in clean rooms.

For this purpose, according to the invention the table is characterized in that each table section has two identical vertical stands in the form of an inverted U which is placed at right angles to the lengthwise direction of the table, and each of the legs of which is provided with a large number of horizontal threaded bushes running lengthwise and fixed in an airtight manner therein at various heights, for detachably fixing leaf supports to the sides of the two stands, for the purpose of supporting one or more table leaves and for detachably fixing under these table leaves at least one partition between two corresponding legs of the adjacent stands.

The identical stands are preferably made up of stainless steel tubular material of rectangular cross-section, the two legs of the inverted U-shaped stand each being shut off in an airtight manner at the underside by a plate, so that each stand bounds an airtight space. This therefore has the advantage that each stand fulfils a buffer function for the compressed air.

This measure also makes it possible for the abovementioned space to have in one of the legs, below table height, a connection point at each side for connecting to a supply system for purified compressed air or for connecting to the next table section, and for the partition fixed detachably between two corresponding legs of two successive stands to be provided with a through air line which is connected at each end between the two connection points to the stands, which through air line is provided approximately in the centre with at least one connection point for pneumatic hand tools.

It is recommended that at least one suspension point for pneumatic hand tools should be provided under each table.

In order to avoid the emission of harmful vapours, each table leaf is made up of layered plywood material without further impregnation, and is provided with a wear-resistant top layer, beneath which there is a conducting layer which in operation is earthed.

The two bottom ends of an inverted U-shaped stand are used to fix the stand to a supporting bar, through the fact that below the plate which shuts off a leg of a stand in an airtight manner there is a second plate provided with a tapped hole, into which a draw bolt fits, with the aid of which bolt the two bottom ends of the U-shaped stand are fixed on a horizontal supporting bar resting on two adjusting feet.

Each table leaf is provided on the underside thereof with inlaid plastic channels in which a number of conducting red copper strips which are earthed are fitted, and of which at least the strip near the table edge is provided with wristband connection facilities.

For the purpose of adapting the height of the worktop, i.e. the table, to the requirements of the personnel, the table leaf supports are detachably fixed in the threaded bushes by means of star-head bolts, and are provided with several, for example three, fixing holes disposed vertically below one another at equal intervals.

Parallel horizontal top sides of two successive stands can serve as supports for an interposed lighting frame for lamps which serve to illuminate the worktop.

The partition is preferably equipped with a horizontally disposed power supply strip, which is inserted into a profiled groove, and is provided with a number of earthed sockets for electrical mains supply, and also one or more switches for operation of the lighting.

All threaded bushes not being used are sealed off in a dustproof manner with cover caps on either side of the stands.

Each table leaf is provided on the top side with one or more cable bushings which can be sealed off.

The power connection cable for the lighting from the switch on the power supply strip is preferably guided through a bushing tube in one of the legs of the stand.

The threaded bushes fixed in an airtight manner in the stands can serve partly for the detachable fixing of one or more extension leaves between the stands above the table leaves.

The invention will be explained in greater detail with reference to a non-limiting example of an embodiment in the appended drawing.

DETAILED DESCRIPTION OF THE DRAWINGS

Figure 2:
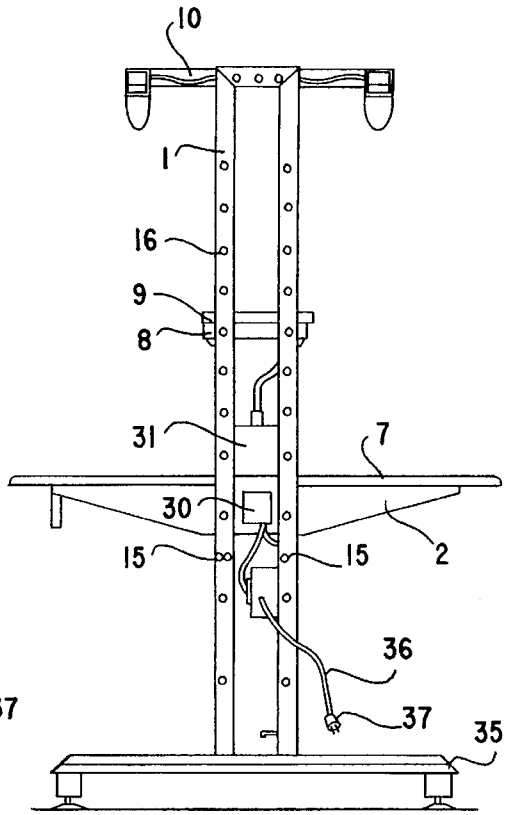
FIG. 2 shows the righthand side view of the table illustrated in FIG. 1.
Figure 1:
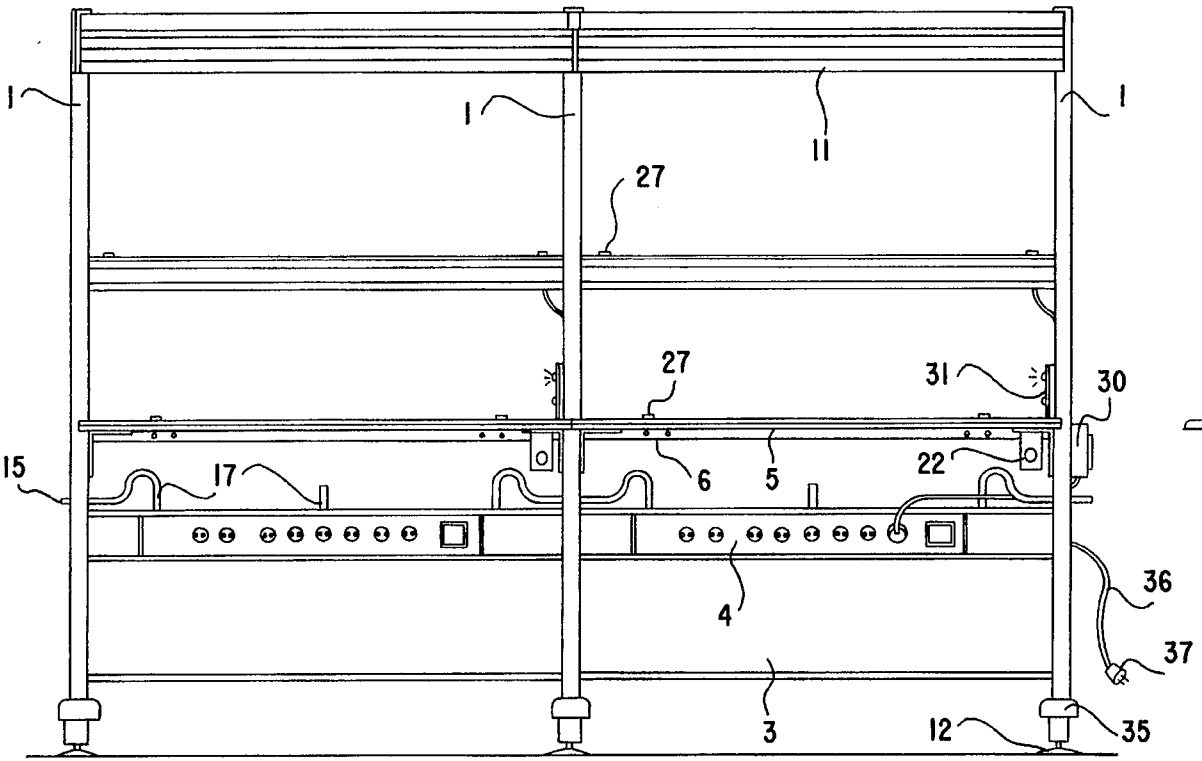
FIG. 1 shows a view of a table according to the invention comprising two sections, suitable for several workplaces.

The table shown in FIGS. 1 and 2 consists of three identical vertical stands 1 in the form of an inverted U. the plane of the U is placed at right angles to the lengthwise direction of the table. Each of the parts is provided with a large number of horizontal threaded bushes 38 running in the lengthwise direction and fixed in an airtight manner therein at various heights. One of the threaded bushes is shown in greater detail in FIGS. 5 and 6. These threaded bushes serve for detachably fixing leaf supports 2 to the sides of the two stands. These leaf supports are detachably fixed in the threaded bushes 38 by means of star-head bolts 19. They are preferably provided with several, for example three, fixing holes disposed vertically below one another at equal intervals. A large range of table heights can be achieved in this way.

Table leaves 7, a total of four in the embodiments shown in FIGS. 1 and 2, lie loose on the table leaf supports 2.

Each table leaf 7 is made up of layered plywood material without further impregnation, and is provided with a wear-resistant top layer, beneath which there is a conducting layer which in operation has to be earthed.

The stands are also detachably connected under these table leaves 7 by at least one partition 3 between two corresponding legs of the adjacent stands 1.

The identical stands 1 are made of stainless steel tubular material with rectangular cross-section, both legs of the inverted U-shaped stand being sealed off at the underside in an airtight manner by a plate 32, so that each stand bounds an airtight space of 27 liters capacity. The abovementioned space in each of the legs has below table height on each side a connection point 15 for connection to a supply system for purified compressed air, or for through-connection to a following table section, as emerges clearly from FIG. 1. The partition 3 detachably fixed between two corresponding legs of two successive stands 1 is provided with a through air line, which is connected at each end to the stands 1 between the two connection points 15, which through air line is provided in the centre with at least one connection point 17 for pneumatic hand tools.

It is advisable for at least one suspension point for pneumatic hand tools to be fitted under each table. Such a suspension point is indicated by reference number 22 in FIG. 7.

Figure 6:
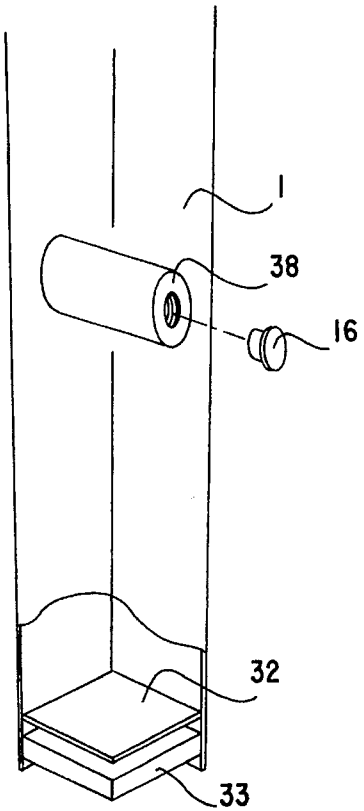
FIG. 6 is a perspective view of the part of FIG. 5, on a slightly enlarged scale.
Figure 5:
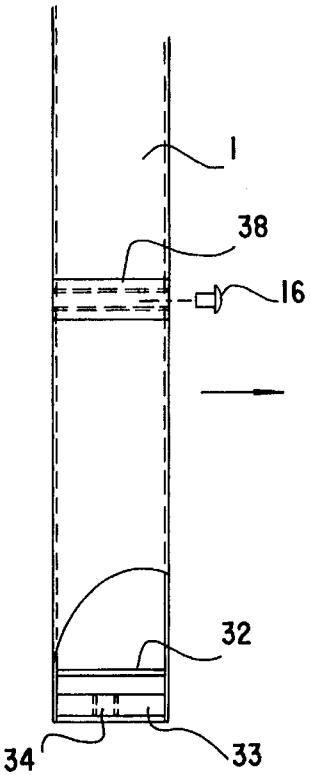
FIG. 5 is a side view, partially in cross-section of the bottom part of one of the stands.

As can be seen from FIGS. 5 and 6, a second, slightly thicker plate 33, which seals off one leg of a stand 1 in an airtight manner at the underside thereof, is situated below the plate 32. This plate 33 is provided with a tapped hole 34, into which a draw bolt (not shown) fits, by means of which bolt the two bottom ends of the inverted U-shaped stand 1 are fixed on a horizontal supporting bar 35 (see FIGS. 1 and 2), which supporting bar 35 rests at both ends thereof on two adjusting feet 12. By adjusting one or both of the adjusting feet, it can be ensured that the entire table stands level on the floor.

As can be seen from FIGS. 1 and 2, the threaded bushes 38 can also serve to fix one or more extension leaves 9 detachably between the stands 1 above the table leaves. Since the threaded bushes 38 are disposed at different heights, it is possible to adapt both the height of the extension leaves and the height of the tables 7 to the ergonomic requirements of the working personnel.

Figure 3:
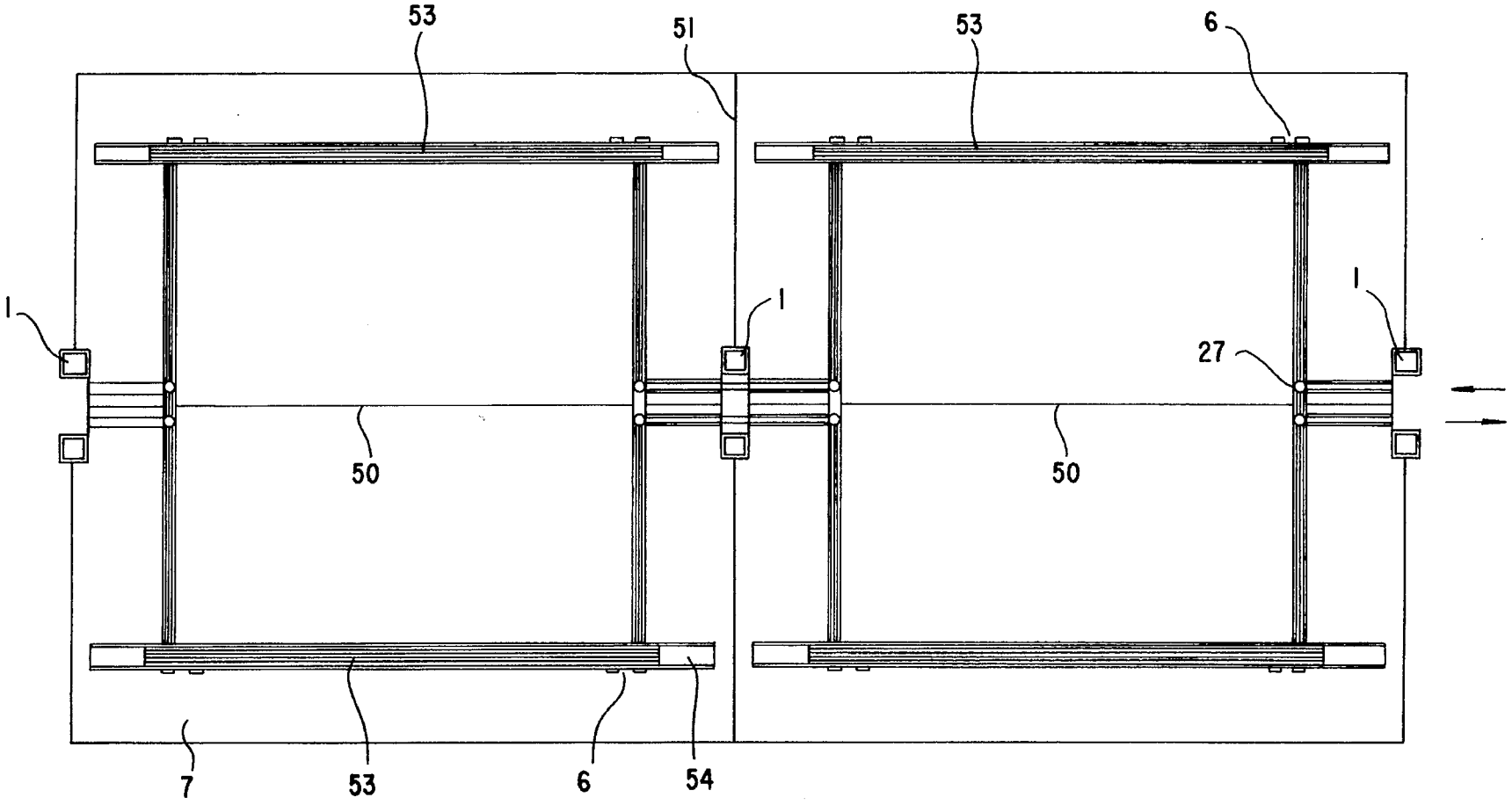
FIG. 3 shows a bottom view of a four-part table leaf, such as that fitted in the table of FIGS. 1 and 2.

FIG. 3 shows a bottom view of a four-part table leaf, of the type which can be seen fitted in the table of FIGS. 1 and 2. These four table leaf segments lie flush against each other, so that only the seams 50, 51 are visible.

A number of plastic channels 54 are laid in each table leaf 7 on this underside, in which channels a number of conducting red copper strips 52, 53 are disposed, which strips are earthed at 27. The strip 53 near each table edge is provided with one or more wristband connection facilities 6, in the form of a socket for a plug. In practice, each person working at this table must wear a wristband around the wrist, which is earthed in this strip by means of a cord of sufficient length with a plug at the end.

At the top side of the stands, the mutually parallel horizontal top sides of two successive stands 1 are designed as supports for an interposed lighting frame 10 for strip lights 11, for illuminating the worktop 7. This frame 10 is fixed to each stand 1 at three places. This lighting of the worktop is such that the workplace is illuminated in the most advantageous way possible, i.e. in such a way that the user works in his own shadow as little as possible.

In order to prevent dust traps from being able to form in the threaded bushes, all threaded bushes 38 not being used are sealed in a dustproof manner by means of cover caps 16 on either side of the stands.

At the top side, each table leaf 7 is provided with a number of cable bushings 13 which can be sealed off. As already mentioned, the partition 3 is equipped with a power supply strip 4, provided with a number of sockets for electrical mains supply and one or more switches for operating the lighting 11. The power connection cable for the lighting 11 from the switch on the power supply strip is run through a bushing tube 14 in one of the legs of the stand 1.

The threaded bushes 38 fixed in an airtight manner in the stands 1 also serve to fix one or more extension leaves 9 detachably between the stands 1 above the table leaves 7. The extension leaf 9 is of the same design as the top 7 and is correspondingly earthed. A set of hinge plates 26, shown separately in FIG. 7, can be used in order to make it possible to move this leaf 9 into a tilted position for a user.

Figure 4:
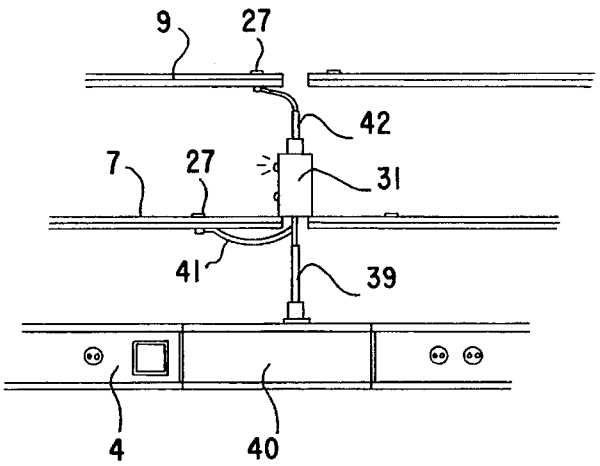
FIG. 4 is a schematic partial view of the positioning of a warning apparatus and the through-connection of the power-supply strip.

It is vitally important to know the earth connection of each part of the sectional table. For this purpose, an ESD monitor or control box 31 is provided between two legs of each stand. This is shown in greater detail in FIG. 4. The control box 31 receives its mains supply through the line 39, which is taken from the power supply strip, while the inlet of the box 31 is connected by means of a cable 41 to the red copper strips of the table leaf 7 and by means of a cable 42 to the corresponding strips of the extension leaf 9. The ESD control box 31 is provided with a visible warning signal in the form of a green and a red LED. When the conduction to earth is sufficient, the green LED is on, but if the red LED of any section lights up, work must be stopped, on account of the risk of static charge.

Characteristic of the sectional table is that it can be placed and moved easily and quickly. The table can also be varied in the workroom in a simple way depending on circumstances. In this case the connection of individual sections is easily possible in all respects, pneumatically and electrically.

Due to the fact that non-degradable surface layers are used and that the metal parts are made of stainless steel, there is no risk of harmful emissions. The connections for air and electricity by means of cable trenches and lines are easily reached, but are also arranged in such a way that dust traps do not form. The table according to the invention is simple to maintain, through the fact that it has smooth and rigid surfaces and as few obstacles as possible in the construction. Seams and sharp edges have also been kept to the minimum.

During working, the connections for compressed air and electricity, and the connection for the wristband (four connections per workplace) are all within reach. The indication that the ESD connections are functioning lies within the field of vision of users.

All connections between parts (such as leaf supports 2 and partitions 3) are by means of plastic star-head bolts with M8 threaded ends. These star-head bolts can be screwed by hand into the threaded bushes 38 without difficulty. No special tools are therefore needed for setting up and disassembling the sectional table.

For fixing the leaves with a depth of, for example, 600 mm, M8 threaded bushes are provided on the underside of thereof. At the rearside of these leaves, loose coupling pins can be used to couple the leaves back-to-back opposite each other, so that leaves always lie in the same plane. Lateral coupling is by means of coupling strips 23 (see FIG. 7) which are fixed at the front side between the strips.

Due to the modular principle, but due also to the chosen construction materials and construction methods, special requirements of clients as regards additional specific products are always possible in a simple way by applying the same principles.

Figure 7:
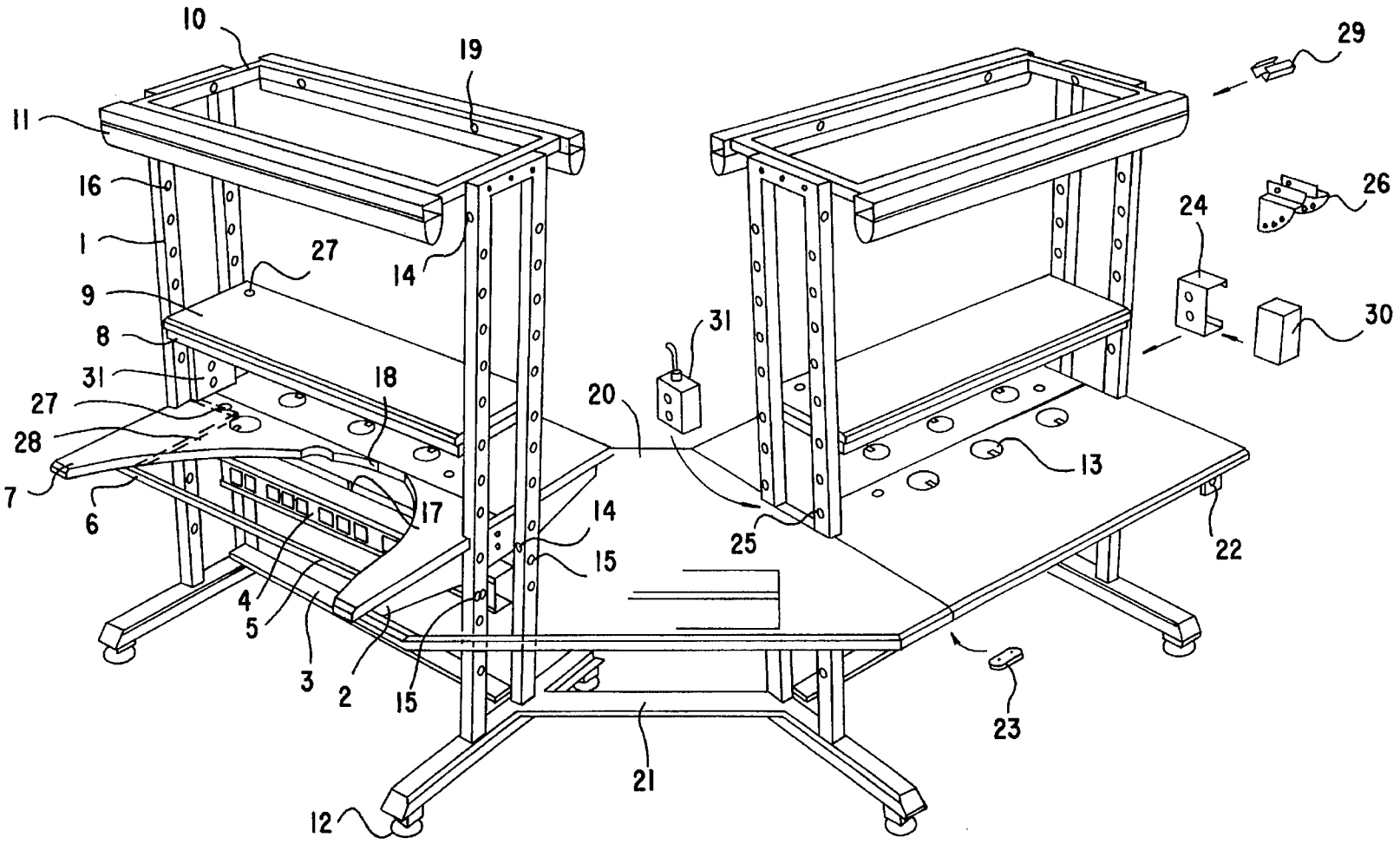
FIG. 7 shows a perspective view of a sectional table with a different arrangement of the component parts thereof.

FIG. 7 shows a perspective view of a sectional table in another arrangement of the component parts thereof. The two outermost fields in this case are at right angles to each other.

What is claimed is:

1. A sectional table for special use as a work table in clean rooms comprising at least one table section and each table section comprises two identical vertical stands (1) and each stand having two vertical legs and a horizontal connecting top member to define an inverted U, said stands each comprising stainless steel tubular material of rectangular cross-section, the two legs having at their respective lower ends a plate (32) sealing each of said lower ends so that each stand defines an airtight inner space, each of the vertical legs having a plurality of horizontal internal threaded bushes (38), said bushes extending in the lengthwise direction of said table through the respective legs at various heights and being sealingly fixed therein to define an airtight connection in two opposite sides of the legs, leaf support (2) being detachably fixed to said bushes to the size of the two stands, one or more table leaves (7) being supported on said leaf supports, at least one partition (3) being detachably fixed between two corresponding legs of the two stands (1), under said table leaves, each stand having in at least one of the legs below table height a connection point (15) at each side for connecting the internal space of said stand to a supply system for purified compressed air or for connecting to an internal space of a next table section, the partition (3) fixed detachably between two corresponding legs of two successive stands (1) has a through air line which is connected at each end between the two connection points (15) to the stands, said air line has substantially in the center thereof at least one connection point (17) for pneumatic hand tools.

2. Sectional table according to claim 1 wherein at least one suspension point (22) for pneumatic hand tools is provided under each table.

3. Sectional table according to claim 1 wherein each table leaf (7) is made up of layered plywood material without further impregnation, and is provided with a wear-resistant top layer, beneath which there is a conducting layer which in operation is earthed.

4. Sectional table according to claim 3, wherein each table leaf (7) is provided on the underside thereof with inlaid plastic channels in which a number of conducting red copper strips which are earthed are fitted, at least the strip near the table edge has means for connecting wristband connection facilities.

5. Sectional table according to claim 1 wherein below the plate (32) which shuts off a leg of a stand (1) in an airtight manner there is a second plate (33) having a tapped hole (34), into which a draw bolt fits, said bolt fixes the two bottom ends of the U-shaped stand (1) on a horizontal supporting bar (35) resting on two adjusting feet (12).

6. Sectional table according to claim 1 wherein the leaf supports (2) are detachably fixed in the threaded bushes (38) by means of bolts, and are provided with a plurality of fixing holes disposed vertically below one another at equal intervals.

7. Sectional table according to claim 1 wherein mutually parallel horizontal top sides of two successive stands (1) can serve as supports for an interposed lighting frame (10) for lamps (11) which serve to illuminate the worktop (7).

8. Sectional table according to claim 1 wherein the partition (3) is equipped with a horizontally disposed power supply strip, which is inserted into a profiled groove, and has a number of earthed sockets for electrical mains supply, and also one or more switches for operation of the lighting (11).

9. Sectional table according to claim 8, wherein the power connection cable for the lighting (11) from the switch on the power supply strip (4) is guided through a special bushing tube (14) in one of the legs of a stand (1).

10. Sectional table according to claim 1 wherein all threaded bushes (38) not being used are sealed off with dustproof cover caps (16) on either side of the stands (1).

11. Sectional table according to claim 1 wherein each table leaf (7) is provided on the top with one or more cable bushings (13) which are adapted to be sealed off.

12. Sectional table according to claim 1 wherein the threaded bushes (38) fixed in the stands (1) detachably fix one or more extension leaves (9) between the stands (1) above the table leaves (7).

* * * * *